US006993984B2

(12) United States Patent
Nishida et al.

(10) Patent No.: US 6,993,984 B2
(45) Date of Patent: Feb. 7, 2006

(54) METHOD AND APPARATUS FOR SUPPLYING SAMPLE SAND FROM A MIXING MACHINE TO A SAND-PROPERTY-MEASURING APPARATUS

(75) Inventors: Tadashi Nishida, Toyokawa (JP); Shigeaki Yamamoto, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 341 days.

(21) Appl. No.: 10/351,437

(22) Filed: Jan. 27, 2003

(65) Prior Publication Data

US 2004/0104151 A1 Jun. 3, 2004

(30) Foreign Application Priority Data

Jan. 28, 2002 (JP) ..... 2002-018234

(51) Int. Cl.
*G01N 1/14* (2006.01)
*G01N 33/00* (2006.01)

(52) U.S. Cl. ..... 73/863.83; 73/863.81; 73/866

(58) Field of Classification Search ..... 73/863.83, 73/863.81, 866, 863.01, 863.02, 863.41
See application file for complete search history.

(56) References Cited

U.S. PATENT DOCUMENTS 6,272,932 B1 8/2001 Nishida ..... 73/823

FOREIGN PATENT DOCUMENTS

| | | |
|---|---|---|
| JP | 63-34775 | 9/1988 |
| JP | 1-15825 | 3/1989 |
| JP | 9-24438 | 1/1997 |

*Primary Examiner*—Hezron Williams
*Assistant Examiner*—Tamiko Bellamy
(74) *Attorney, Agent, or Firm*—Finnegan, Henderson, Farabow, Garrett & Dunner, L.L.P.

(57) ABSTRACT

A method and apparatus for supplying sample sand from a mixing machine to a sand-property-measuring apparatus so that sample sand having no clump of sand is sampled, and so that the value of the compactibility correlates with the value measured by conventional sand-property-measuring apparatus.

4 Claims, 1 Drawing Sheet

METHOD AND APPARATUS FOR SUPPLYING SAMPLE SAND FROM A MIXING MACHINE TO A SAND-PROPERTY-MEASURING APPARATUS

TECHNICAL FIELD

This invention relates to a method and apparatus for supplying sample sand from a mixing machine to a sand-property-testing apparatus by a sand-supplying apparatus that is installed in the sidewall of the mixing machine.

BACKGROUND ART

It is well known that to control the condition of casting sand, sample sand in a mixing machine is sampled while it is being mixed, the quality of the mixed sample sand is measured, and then the condition of the mixed casting sand is controlled based on the result of the measurement, as is disclosed in Japanese Patent Early-publication No. 9-24438, etc.

However, there was a problem in that when the method of supplying sample sand was improper, namely, when the sample sand that was sampled by the sand-supplying apparatus installed in the sidewall in the mixing machine was improper, the measured value was unstable.

For example, in measuring the value of the CB (compactibility), when the speed of rotation of a sampling screw is slow, a clump of sand will be formed or the sand will not be effectively loosened or broken up. When a clump of sand is contained in the sample sand, the value of the CB becomes unstable. On the other hand, when the speed of the sampling screw is too fast, the sand scatters and the screw wears rapidly.

Further, when the speed of rotation of the screw was improper, there was no correlation between the value of the CB that was measured by using a sand rammer, which is used in a sand-property-measuring apparatus, and which is currently and commonly used off-line, and the value of the CB that was measured by using a squeeze-compression method. Thus, there were problems in that the measured value of the CB could not be compared with the commonly used one, and in that there were a number of reference points for the control. Hence, these problems resulted in a complex control over the sand property.

Thus, the conventional method of supplying sample sand could not always maintain a correlation between the value of the CB with the value measured by using the conventional sand-property-measuring apparatus.

DISCLOSURE OF INVENTION

This invention is made considering the above problems. The purpose of this invention is to provide a method and apparatus for supplying sample sand from a mixing machine to a sand-property-measuring apparatus so that sample sand having no clump of sand is sampled, and so that the value of the CB correlates with the value measured by the conventional sand-property-measuring apparatus.

To achieve the above purpose, in the method of this invention for supplying sample sand from a mixing machine to a sand-property-measuring apparatus, the sand-supplying apparatus comprises an opening that is made at a given height in a sidewall of the mixing machine for sampling the sand, a guide tube that is installed in the sidewall of the mixing machine such that it protrudes, and wherein the opening portion of the guide tube corresponds to the sand-sampling opening, and a sampling screw, which is connected to a motor mounted on a stationary supporting plate that has a surface parallel to a tangent direction of a sidewall of the mixing machine, and which passes through the guide tube with a given interval from its inside surface, the tip portion of which extends to the inside of the mixing machine. The method is characterized by the steps of further loosening the sample sand by loosening rods that are disposed parallel to an axis of the sampling screw at two or more positions on an imaginary periphery, the diameter of which is larger than that of the sampling screw, and changing the number of rotations of the sampling screw in correspondence to a change in pressure of the sand squeezed from the mixing machine.

In other words, this invention was made based on an observation that as mixing progresses, the sampling condition changes according to changes in the rotational resistance and squeezing pressure exerted on the sand to be sampled, and further, that the sampling condition can be adjusted by changing the number of rotations of the sampling screw in correspondence to a change in the squeezing pressure.

The method of this invention for supplying sample sand from the mixing machine to the sand-property-measuring apparatus can realize a proper supply of sample sand so as to achieve a correlation between the values of the CB obtained by both the conventional sand-property-measuring apparatus and this invention.

When using a mixing machine wherein sand is mixed while downward mixing pressure is applied thereto, preferably the number of rotations of the sampling screw lies in a range of 500–900 rpm in a case where the peripheral speed of the mixing machine is 150–250 m/min, and the sampling screw lead is 20–70 mm. On the other hand, when using a mixing machine wherein sand is mixed while sideways mixing pressure is applied thereto, preferably the number of rotations of the sampling screw lies in a range of 500–900 rpm in a case where the peripheral speed of the mixing machine is 300–500 m/min and the sampling screw lead is 20–70 mm.

To achieve the above purpose the apparatus of this invention for supplying sample sand from a mixing machine to a sand-property-measuring apparatus comprises an opening that is made at a given height in a sidewall of the mixing machine for sampling sand, a guide tube that is installed in the sidewall of the mixing machine such that it protrudes, wherein the opening portion of the guide tube corresponds to the sand-sampling opening, and a sampling screw, which is connected to a motor mounted on a stationary supporting plate that has a surface parallel to a tangent direction of a sidewall of the mixing machine, and which passes through the guide tube with a given interval from its inside surface, the tip portion of which extends to the inside of the mixing machine. The apparatus is characterized in that loosening rods are disposed parallel to an axis of the sampling screw at two or more positions on an imaginary periphery, the diameter of which is greater than that of the sampling screw, and the length of the guide tube is 100–150 mm.

The apparatus of this invention for supplying sample sand from the mixing machine to the sand-property-measuring apparatus can realize a proper supply of sample sand by eliminating any clump of sand from being mixed with the sample sand and by utilizing the effect of loosening the sample sand so as to achieve a correlation between the values of the CB obtained by both the conventional sand property-measuring apparatus and this invention.

PREFERRED EMBODIMENTS OF INVENTION

Figure 1:
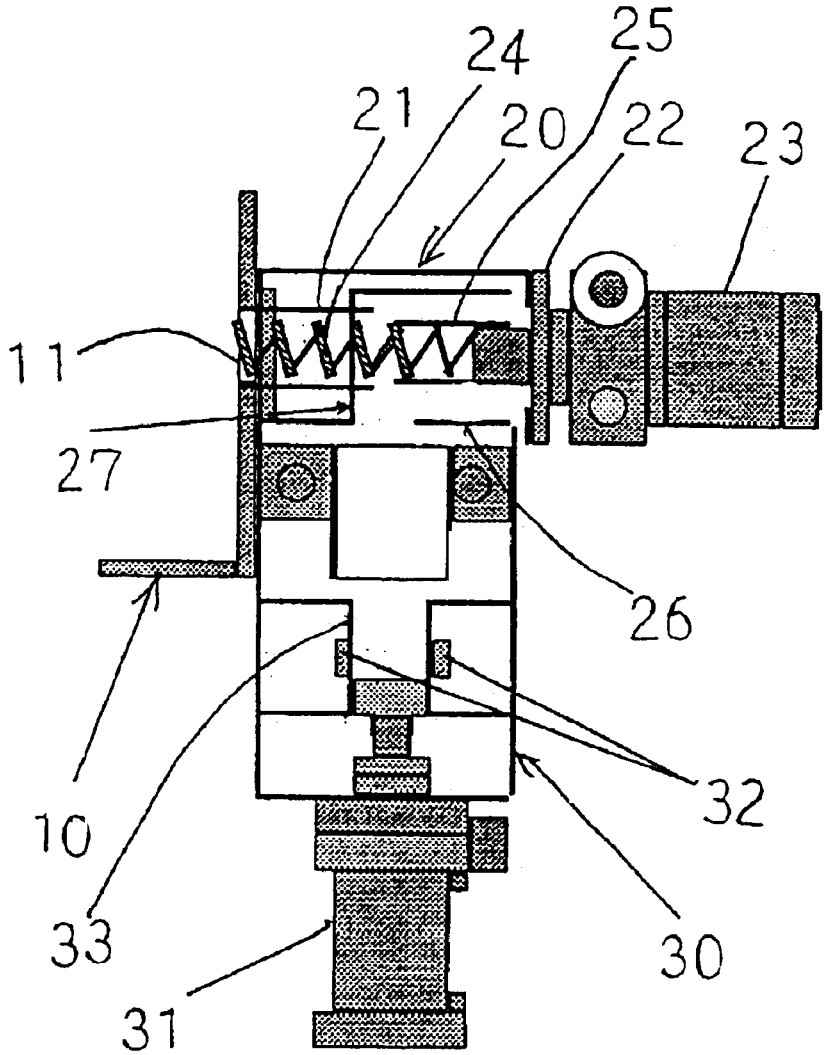
FIG. 1 is a schematic vertical cross section to show an embodiment of this invention.

An embodiment of this invention will now be explained in reference to FIG. 1. It illustrates a sample-sand-supply apparatus 20 for connecting a mixing machine 10 with a sand-testing apparatus 30.

The sample-sand-supplying apparatus 20 of this invention is disposed in one side of a mixing machine 10. The apparatus 20 is for sampling casting sand while it is being mixed. A sand-testing device 30 that serves as a CB-value-measuring apparatus is disposed in the lower part of the sample-sand-supplying apparatus 20. The sand-testing device 30 serves both as a CB-value-measuring means 31 for casting sand and as a measuring means 32 for measuring the water/temperature of a sample mold formed from the casting sand. The CB-value-measuring means 31 and water/temperature-measuring means 32 are electrically connected to respective memories. The memories are electrically connected to operation means, to which CB-control means are electrically connected.

Below we detail these respective means. In the drawing the sample-sand-supplying apparatus 20 is connected to a sand-sampling opening 11 that is made at a given height in the sidewall of the mixing machine 10: the apparatus 20 comprises a guide tube 21 that extends outward from the sidewall of the mixer 10, and that is caused to have its opening coincide with the sand-sampling opening 11, a motor 23 mounted on a stationary-support plate 22 that has a surface parallel to a direction tangent to the sidewall of the mixing machine 10, and a sampling screw 24 which passes through the guide tube 21 with a given interval between itself and the inside of the guide tube 21, one end of which extends to the inside of the mixing machine 10. A baffle 26 for baffling the sample sand and a cover 27 for covering the sampling screw 24 and the rods 25 are also disposed around the apparatus 20.

A plurality of loosening rods 25 are disposed within the guide tube 21 in a direction parallel to an axis of the sampling screw 24 along an imaginary periphery, the diameter of which is greater than that of the envelope of an imaginary periphery of the sampling screw 24. The length of the guide tube 21 extending outward from the sidewall of the mixing machine 10 is 100–150 mm. In a preferred embodiment of this invention, four loosening rods 25, one end of each of which loosening rods 25 is mounted on the shaft of the motor 23, are disposed equidistantly along the imaginary periphery.

The number of rotations of the sampling screw 24 can be changed in correspondence to a change in the roller pressure, to squeeze the sand out of the mixing machine 10. Since in this embodiment pressing rollers (not shown) exert a mixing pressure toward the bottom of the mixing machine 10, the number of rotations of the sampling screw 24 is set at 500–900 rpm when the mixing machine 10 is operated at a peripheral speed of 150–250 m/min and a screw lead of 20–70 mm.

The sand-testing device 30 that works as the CB-value-measuring-apparatus is for measuring the ratio of the amount of casting sand after it has been contracted to its total amount: namely, a given amount of casting sand is charged into a cylinder 33, and the value of the drop in the top surface of the cylindrical casting sand is measured after it has been compressed. In concrete terms, it uses the well-known sand-testing device disclosed in Japanese Patent Publication No. 1-15825. The water/temperature-measuring means 32 used for a sample mold comprises the means that is now explained: a sample mold, e.g., a cylindrical mold, is made by compressing a given amount of casting sand measured in a testing tube; a size of 50 Φ×50 H is used for the sample mold; the water and temperature is measured by compressing the mold from both the upper and lower sides; the water is measured by an electric resistor and the temperature is measured by a thermostat; in the water/temperature-measuring means 32, e.g., electrodes are disposed in separate curved surfaces of the testing tube 33 for pressing the casting sand, and a thermostat is mounted on one surface of the testing tube 33; also, the thermostat may be disposed in the sidewall of the mixing machine, and its end may extend a little thereinto.

A microcomputer is used as memory means and operation means. The CB-control means receive measurements after the mixing machine 10 has started to knead the casting sand and the properties of the casting sand have been measured so as to calculate the amount of water needed to achieve the target value of the CB so that the needed water is supplied into the mixing machine from a water tank or service pipe. CB control means are well known as is disclosed in Japanese Utility Model Publication No. 63-34775.

We now explain the operation of the thus-constituted apparatus of this invention. The sample-sand-supplying apparatus 20 is disposed in one side of the mixing machine 10 so as to sample casting sand while loosening it by the sampling screw 24. When a mixing machine is used of the type wherein casting sand is mixed while it is being pressed toward the bottom of the mixing machine 10 by pressing rollers, the peripheral speed of the mixing machine 10 is adjusted as follows: preferably, the sampling screw 24 is rotated at a number of rotations from 500 to 900 rpm, when the peripheral speed of the mixing machine 10 is set at 150–250 m/min and the screw lead of the sampling screw 24 is set at 20–70 mm.

This invention has an advantage in that any clump of sand can be definitely broken up by disposing two or more loosening rods 25 in a direction parallel to an axis of the sampling screw 24, along an imaginary periphery, the diameter of which periphery is greater than that of the periphery of the sampling screw 24, so as to loosen or break up the clump.

Also, this invention has a further advantage in that a clump of sand can be more effectively broken up by replacing the guide tube 21, extending outward from the sidewall of the mixing machine 10, with a longer one, having a length of 100–150 mm.

In conclusion, in this invention after a series of procedures the CB-control means finally control the amount of water to be supplied to the casting sand being mixed, including the steps of supplying casting sand into the testing tube 30 of the sand-testing device serving as a CB-value-measuring apparatus; calculating the CB values; forming a testing mold by using casting sand having the same CB value to measure its water and temperature; memorizing the CB value and water/temperature data; and then the amount of water is determined by using a predetermined target value for the CB.

As stated above, the sample-sand-supplying method in accordance with this invention has achieved the purpose of calculating, monitoring, and controlling the value of the CB.

As the result of this, we were able to confirm that a correlation has been achieved between the conventional sand property-measuring apparatus and the value of the CB by means of the sample-sand-supplying method and the testing device 30 serving as the CB-value-measuring apparatus of this invention.

EFFECTS OF INVENTION

As is clear from the above explanation, this invention has adopted loosening rods disposed parallel to the sampling screw and a method of changing the number of rotations of the sampling screw, in addition to adopting the so-called drawing-out system of the sand-supplying apparatus for sample sand disposed in one side of the mixing machine. Thus, it has provided the industry with great effects in eliminating any clumps in sample sand and in obtaining a correlation between the CB values that are obtained by the conventional sand-property-measuring apparatus and those obtained by this invention.

SUMMARY

The purpose of the sand-supplying method and apparatus of this invention is to supply sample sand from a mixing machine to a sand-property-measuring apparatus with no clump of sand being mixed therewith, so as to obtain a correlation between the CB values measured by the conventional measuring apparatus and that of this invention.

What is claimed is:

1. A method of supplying sample sand from a kneading machine to a sand-property-measuring apparatus by a sand-supplying apparatus that comprises an opening that is made at a given height in a sidewall of the kneading machine for sampling sand, a guide tube that is installed in a sidewall of the kneading machine such that the guide tube protrudes therefrom, wherein the opening portion of the guide tube corresponds to the sand-sampling opening, and a sampling screw, which is connected to a motor mounted on a stationary supporting plate that has a surface parallel to a tangent direction of a sidewall of the kneading machine, and which passes through the guide tube with a given interval from its inside surface, a tip portion of which extends to an inside of the kneading machine, the method being characterized by the steps of further loosening the sample sand by means of loosening rods that are disposed parallel to an axis of the sampling screw at two or more positions on an imaginary periphery, the diameter of which is greater than that of the sampling screw, and changing the number of rotations of the sampling screw in correspondence to a change in pressure of the sand squeezed from the kneading machine.

2. The method of claim 1, characterized in that the number of rotations of the sampling screw lies in a range of 500–900 rpm when the sand is kneaded while downward kneading pressure is applied thereto, and when the peripheral speed of the kneading machine is 150–250 m/min and the sampling screw lead is 20–70 mm.

3. The method of claim 1, characterized in that the number of rotations of the sampling screw lies in a range of 500–900 rpm when the sand is kneaded while sideways kneading pressure is applied thereto, and when the peripheral speed of the kneading machine is 300–500 m/min and when the sampling screw lead is 20–70 mm.

4. An apparatus for supplying sample sand from a kneading machine to a sand-property-measuring apparatus comprises an opening that is made at a given height in a sidewall of the kneading machine for sampling sand, a guide tube that is installed in a sidewall of the kneading machine such that the guide tube protrudes therefrom, wherein the opening portion of the guide tube corresponds to the sand-sampling opening, and a sampling screw, which is connected to a motor mounted on a stationary supporting plate that has a surface parallel to a tangent direction of a sidewall of the kneading machine, and which passes through the guide tube by a given interval from its inside surface, a tip portion of which extends to an inside of the kneading machine, the apparatus being characterized in that loosening rods are disposed parallel to an axis of the sampling screw at two or more positions on an imaginary periphery, the diameter of which is greater than that of the sampling screw, and in that the length of the guide tube is 100–150 mm.

* * * * *